310-14 SR
FIP8502 XR 4,493,253

United States Patent [19]
Vyas

[11] Patent Number: 4,493,253
[45] Date of Patent: Jan. 15, 1985

[54] VARIABLE IMPACT PRINTING MEANS

[75] Inventor: Arvindkumar C. Vyas, Waterloo, Canada

[73] Assignee: NCR Canada Ltd., Mississauga, Canada

[21] Appl. No.: 554,743

[22] Filed: Nov. 23, 1983

[51] Int. Cl.[3] ..... B41J 9/38; B41J 9/42
[52] U.S. Cl. ..... 101/93.03; 400/157.3; 400/166; 310/14
[58] Field of Search ..... 101/93.03, 93.48; 400/157.3, 157.2, 166; 310/14

[56] References Cited

U.S. PATENT DOCUMENTS

| | | | |
|---|---|---|---|
| 3,172,353 | 3/1965 | Helms | 101/93 |
| 3,335,659 | 8/1967 | Schacht et al. | 101/93 |
| 3,548,273 | 12/1970 | Parodi et al. | 310/14 X |
| 3,611,783 | 10/1971 | Mittelmann | 310/14 X |
| 3,630,142 | 12/1971 | Fulks et al. | 101/93 R |
| 3,705,370 | 12/1972 | Chai et al. | 335/229 |
| 3,741,113 | 6/1973 | Mako et al. | 101/93 |
| 3,775,714 | 11/1973 | Heuer | 335/230 |
| 3,878,778 | 4/1975 | Gomi | 101/93.29 |
| 4,046,244 | 9/1977 | Velazquez | 197/1 R |
| 4,218,150 | 8/1980 | Swaim | 400/124 |
| 4,401,026 | 8/1983 | Brown | 101/93.33 |

FOREIGN PATENT DOCUMENTS

| | | | |
|---|---|---|---|
| 17918 | 10/1980 | European Pat. Off. | 101/93.03 |
| 1275356 | 5/1972 | United Kingdom | 101/93.48 |

OTHER PUBLICATIONS

Abraham, et al., "Multiple Energy Print Hammer", *IBM Technical Disclosure Bulletin*, p. 202, vol. 15, No. 1, June 1972.

United States patent application Ser. No. 491,117, filed May 3, 1983, inventor Ali T. Mazumder, assigned to NCR Canada Ltd.-NCR Canada Ltee, the assignee of the present patent application.

*Primary Examiner*—Clifford D. Crowder
*Attorney, Agent, or Firm*—Albert L. Sessler, Jr.

[57] ABSTRACT

A variable impact printing mechanism includes a supporting magnetic structure having a plurality of circumferential coils mounted thereon and having a central bore in which a magnetic hammer element is positioned for linear movement to cooperate with a type member positioned adjacent to one end of the bore in order to effect printing on a record member positioned between the hammer and the type member. A controller is provided to energize drivers for the various coils in predetermined sequences to vary the velocity achieved by the hammer element at the end of its printing movement in accordance with varying printing requirements.

11 Claims, 6 Drawing Figures

VARIABLE IMPACT PRINTING MEANS

BACKGROUND OF THE INVENTION

A need exists in printing apparatus for a print hammer driving mechanism which can provide optimum hammer speed and variable hammer impact. Variations in the desired amount of hammer impact force may arise for a number of reasons, such as variations in the number of copies to be printed simultaneously; variations in the effective areas of individual characters to be printed, such as, for example, the area of the letter "w" as compared to the area of the letter "v", or the area of the number "8" as compared to the area of the number "1"; the quality of print which may be required for a particular application; and the style or font of a character to be printed.

The desirability of controlling printing intensity has been recognized, for example, in U.S. Pat. No. 3,172,353, in which energy produced by a magnetic field and imparted to a print hammer can be reduced by reducing the amplitude of the current driven through the coil.

SUMMARY OF THE INVENTION

In the present invention, variable print hammer force in a printing apparatus is provided by use of a plurality of operating means, each of which is controlled separately so that in each case the magnitude and direction of the applied current can be varied.

In accordance with one embodiment of the present invention, variable impact printing mechanism comprises, in combination, hammer means capable of moving between a rest position and an operated position in which said hammer means cooperates with a print indicia element to effect printing upon a record medium; support means capable of defining the path of the hammer means; a plurality of hammer operating means mounted in operative relation to said support means, each of said hammer operating means being capable of affecting the movement of said hammer means along said path; driving means for energizing said hammer operating means; and controller means for controlling said driving means to cause said plurality of hammer operating means to act in a predetermined sequence of operation to move said hammer means along said path, to provide varying printing impact forces in response to varying printing requirements.

It is accordingly an object of the present invention to provide a printing apparatus in which the impact of the print hammer can be varied in accordance with different printing requirements.

A further object is to provide a printing apparatus in which a plurality of cooperating hammer operating means are provided.

A further object is to provide a printing apparatus in which a plurality of electromagnetic coils are sequentially operated by a controller to determine the direction and velocity of a print hammer.

With these and other objects, which will become apparent from the following description, in view, the invention includes certain novel features of construction and combinations of parts, a plurality of forms or embodiments of which are hereinafter described with reference to the drawings which accompany and form a part of this specification.

DETAILED DESCRIPTION OF THE PREFERRED EMBODIMENT

Figure 1:
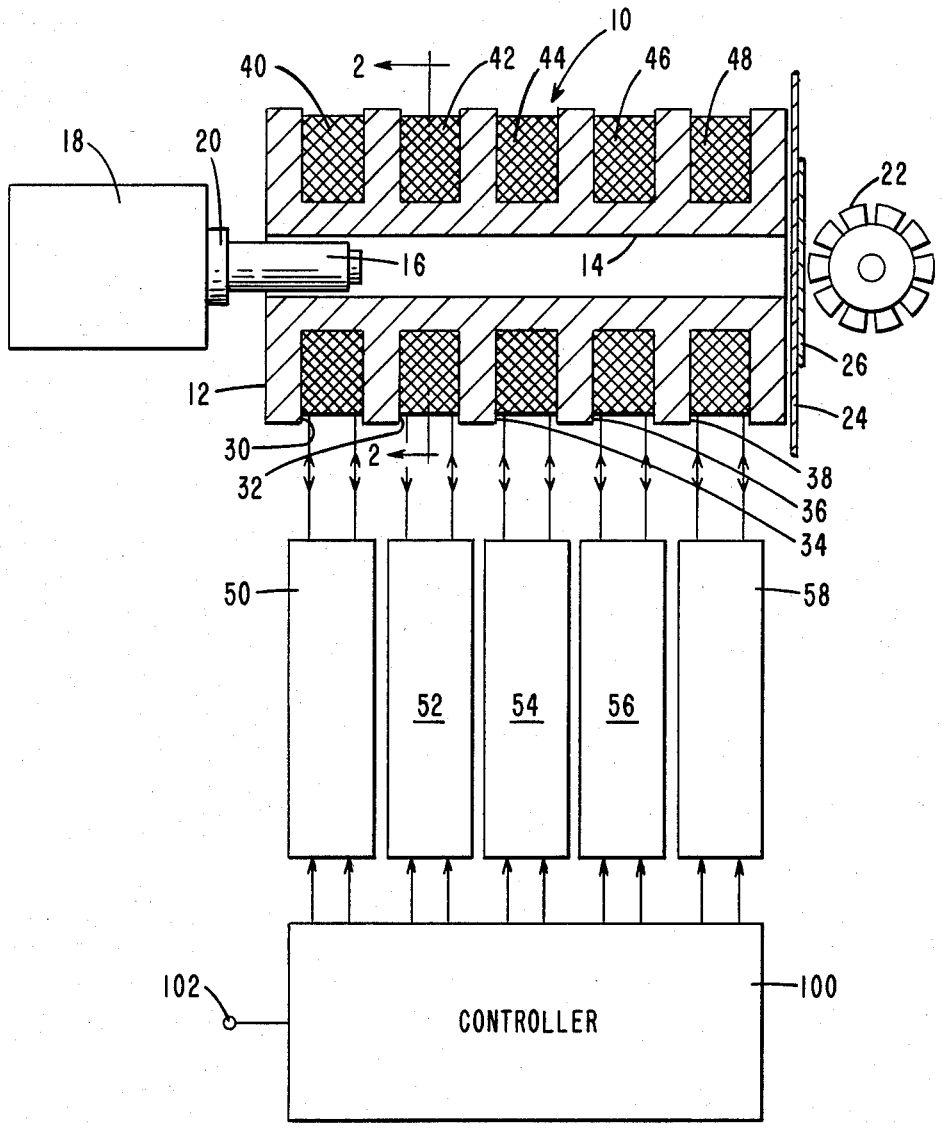
FIG. 1 is a partially schematic sectional view of a first embodiment of the invention.
Figure 2:
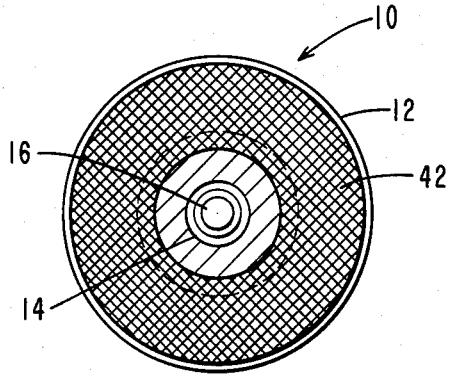
FIG. 2 is a sectional view taken along line 2—2 of FIG. 1.

Referring now to FIGS. 1 and 2, there is shown a printing apparatus 10 comprising a stationary support structure 12 of generally cylindrical configuration which is formed of magnetic material. The structure 12 is provided with a central circular bore 14 in which is located a cylindrical hammer 16, also of magnetic material. Other complementary configurations of bore 14 and hammer 16 could, of course, be employed if desired, and the longitudinal configuration of hammer 16 could also be altered as desired.

When at rest at one end of the bore 14, the hammer 16 is positioned adjacent to a stop member 18 which may include a dashpot 20 for absorbing the energy of the hammer 16 as it returns to its rest position, thereby minimizing noise and vibration in the operation of the printing mechanism.

Positioned adjacent to the other end of the bore 14 is a type member 22 with which the hammer 16 cooperates to effect printing on a record member 24 which may be, for example, a bank check. A ribbon 26 may be positioned between the type member 22 and the record member 24.

The support structure 12 is provided with a plurality of circumferential slots 30, 32, 34, 36, 38 within which are wound a corresponding plurality of electromagnetic coils 40, 42, 44, 46 and 48.

Figure 3:
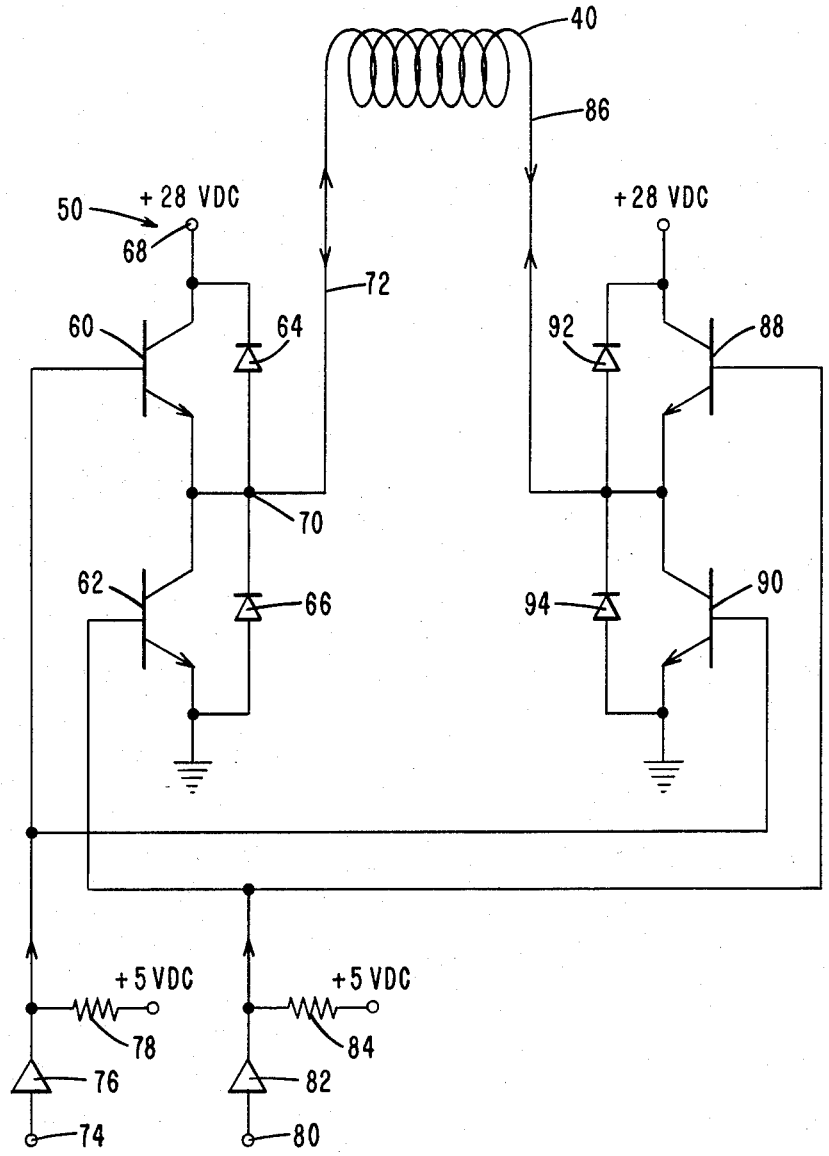
FIG. 3 is a schematic diagram of a coil driver circuit.

Each coil 40, 42, 44, 46, and 48 is controlled by a corresponding coil driver 50, 52, 54, 56, and 58, shown in block form in FIG. 1. The circuit configuration of driver 50 is shown in FIG. 3, and it should be noted that the other drivers are identical thereto in design. This circuit is of the push-pull type and includes two branches, each of which is coupled to one end of the coil 40. The left branch, as viewed in FIG. 3, includes two NPN transistors 60 and 62, which may be of type 2N6388, made by Motorola Semiconductor Products Inc., Phoenix, Ariz., and also includes two diodes 64 and 66, which may be of type 1N4001, made by Motorola Semiconductor Products Inc., and which are included in the circuit to protect the transistors 60 and 62 from back EMF produced when the coil 40 is deenergized.

The collector of the transistor 60 is connected at 68 to a source of potential, shown as +28 volts D.C. in FIG. 3. The collector is also connected through the diode 64 to a node 70 from which one circuit path extends over a conductor 72 to one end of the coil 40. A second circuit path extends from the node 70 to the emitter of the transistor 60; a third circuit path extends from the node 70 to the collector of the transistor 62; and a fourth circuit path extends from the node 70 through the diode 66 to the emitter of the transistor 62 and to a base reference potential, shown as ground. A first logic input 74 is connected through an open collector gate 76, which may be of type 7407, made by Signetics Corporation, Sunnyvale, Calif., to the base of the transistor 60 and to the base of a transistor 90 in the right circuit branch. A potential of +5 volts is applied through a 10,000-ohm pull-up resistor 78 to the gate 76. A second logic input 80 is connected through an open collector gate 82, which may be of type 7407, to the base of the transistor 62 and to the base of a transistor 88 in the right circuit branch. A potential of +5 volts D.C. is applied through a 10,000-ohm pull-up resistor 84 to the gate 82.

The other end of the coil 40 is coupled via a conductor 86 to the right branch of the circuit of FIG. 3, which includes NPN transistors 88 and 90 and diodes 92 and 94, which may be of the same types as the corresponding components in the left circuit branch. The various circuit paths connecting these components are similar to the corresponding circuit paths of the left branch, as may be seen from an inspection of FIG. 3.

It may readily be seen that the logic levels on inputs 74 and 80 determine the direction of current flow within the coil 40. If the signal level at input 74 is at a suitable positive (or "one") logic level, and the signal level at input 80 is at a suitable negative (or "zero") logic level, transistors 60 and 90 are conducting in a saturated state, and transistors 62 and 88 are cut off. In such case, the direction of current flow through the coil 40 is clockwise. Conversely, if the signal level at input 74 is negative (or "zero") and the signal level at input 80 is positive (or "one"), the transistors 60 and 90 are cut off and the transistors 62 and 88 are conducting. In such case, the direction of current flow through the coil 40 is counterclockwise, or reversed from the direction of current flow with the logic inputs having the opposite values. If the logic levels at both inputs 74 and 80 are at a suitable negative (or "zero") logic level, all four of the transistors 60, 62, 88 and 90 are cut off, and no current flows through the coil 40.

The logic inputs 74, 80 for the driver 50, and the corresponding logic inputs for the drivers 52, 54, 56 and 58 are coupled to a controller 100, represented in block form in FIG. 1. The controller 100 comprises a suitably programmed microprocessor, which may be of type 8048 manufactured by Intel Corporation of Santa Clara, Calif.

Information relevant to print intensity which may include the identity and font of the character to be printed, the thickness and composition of the record media 24 to be printed upon, and other pertinent information, is provided to the controller 100 by suitable means, represented diagrammatically in FIG. 1 by the input 102. This information is used to address a look-up table stored in the memory in the controller 100 which will provide a suitable combination of logic signals on the various inputs such as 74 and 80 of driver 50 to produce the desired energizations of coils 40, 42, 44, 46, 48 in the desired sequence to cause the hammer 16 to be driven through the bore 14 to provide the desired velocity for printing in cooperation with the type member 22. Alternatively, such sequential coil energization can be used to return the hammer 16 to the rest position in which it is shown in FIG. 1.

Variables in coil energization which can be used to produce variations in print hammer velocity include the energization or non-energization of a given coil, the direction of energization of a given coil, the duration of energization of a given coil and the sequence in which the various coils are energized. It will be seen that with the illustrated number of five coils (a different number could be used if desired) available to influence the movement or "flight" of the hammer 16 through the bore 14, a wide range of incremental energization forces by the various coils is available. For example, the maximum hammer velocity may be obtained by energizing the coils in the sequence 40, 42, 44, 46, 48. To produce a lower velocity, only certain of the coils may be energized, as in the sequence 40, 44, 48. Alternatively, all five coils could be energized as before, with one of the coils then being reenergized as the hammer 16 passes it, in order to provide a braking effect, as in the sequence 40, 42, 44, 46, 48, 46. Another way in which to provide a braking effect would be to have one or more of the coils energized in a reverse direction at a suitable time in the sequence. Finally, the hammer 16 can be brought back to its rest position by energizing the coils in the reverse sequence and the reverse direction, as in the sequence 48, 46, 44, 42, 40. A braking effect can be produced as the hammer reaches its rest position by appropriate reenergization of one or more of the coils, as in the sequence 48, 46, 44, 42, 40, 42, 40. It will be seen that a wide variety of hammer velocities can be obtained using different combinations of coil energizations, and that these various combinations can be read out of the look-up table and applied to the coil drivers 50, 52, 54, 56, 58 in response to information applied to the input 102.

If necessary, additional variation in hammer velocity can be obtained by selectively changing the amount of current flowing through the various coils 40, 42, 44, 46, 48. One way in which this can be accomplished is by varying the base drive voltage applied to the transistors in the coil driver circuits 50, 52, 54, 56, 58. Shown in FIGS. 4 and 5 is one circuit arrangement which may be employed to provide such a variation of base drive voltage.

Figure 4:
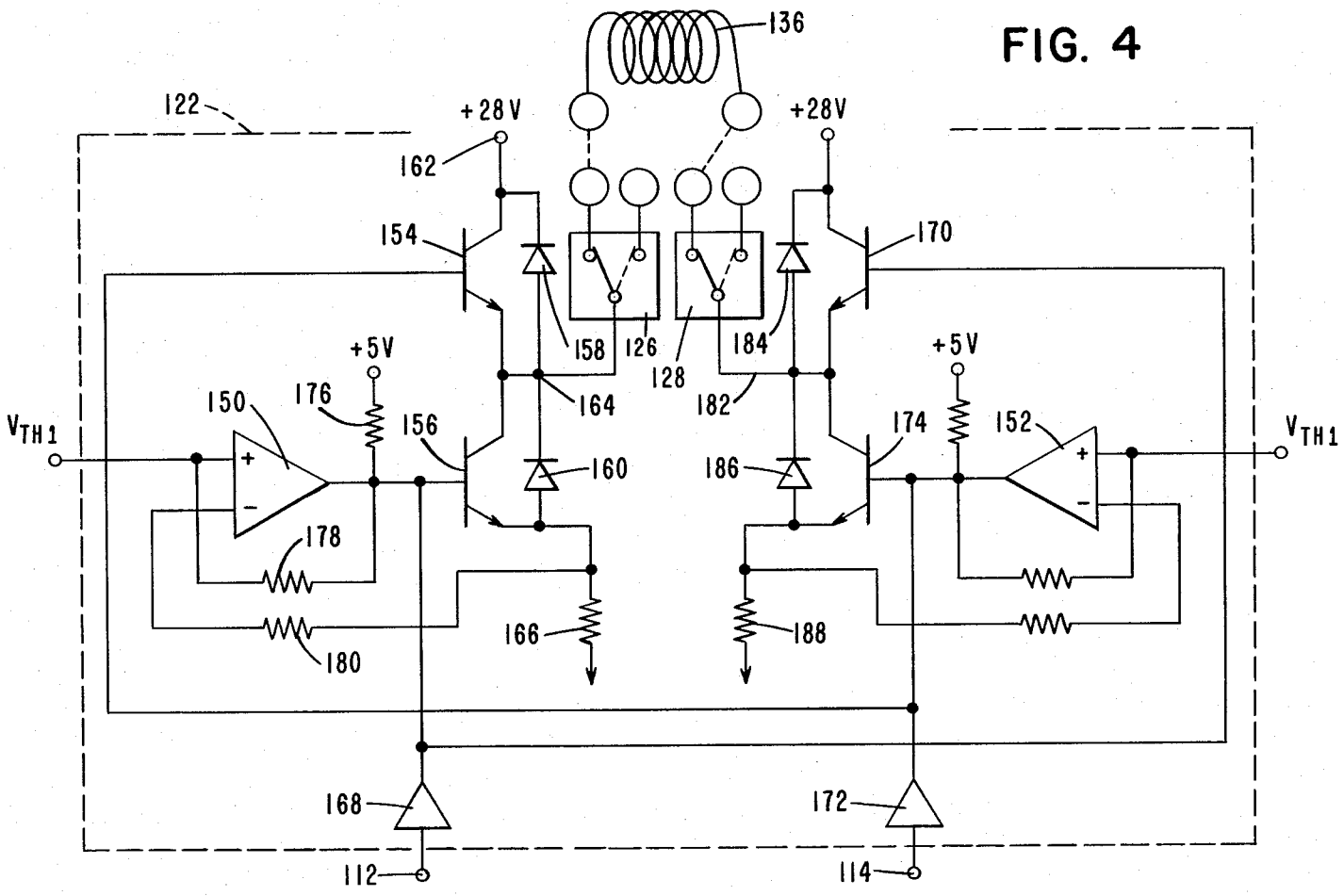
FIG. 4 is a schematic diagram of a second embodiment of the invention, having a modified form of coil driver circuit in which the coil energizing current can be varied.
Figure 5:
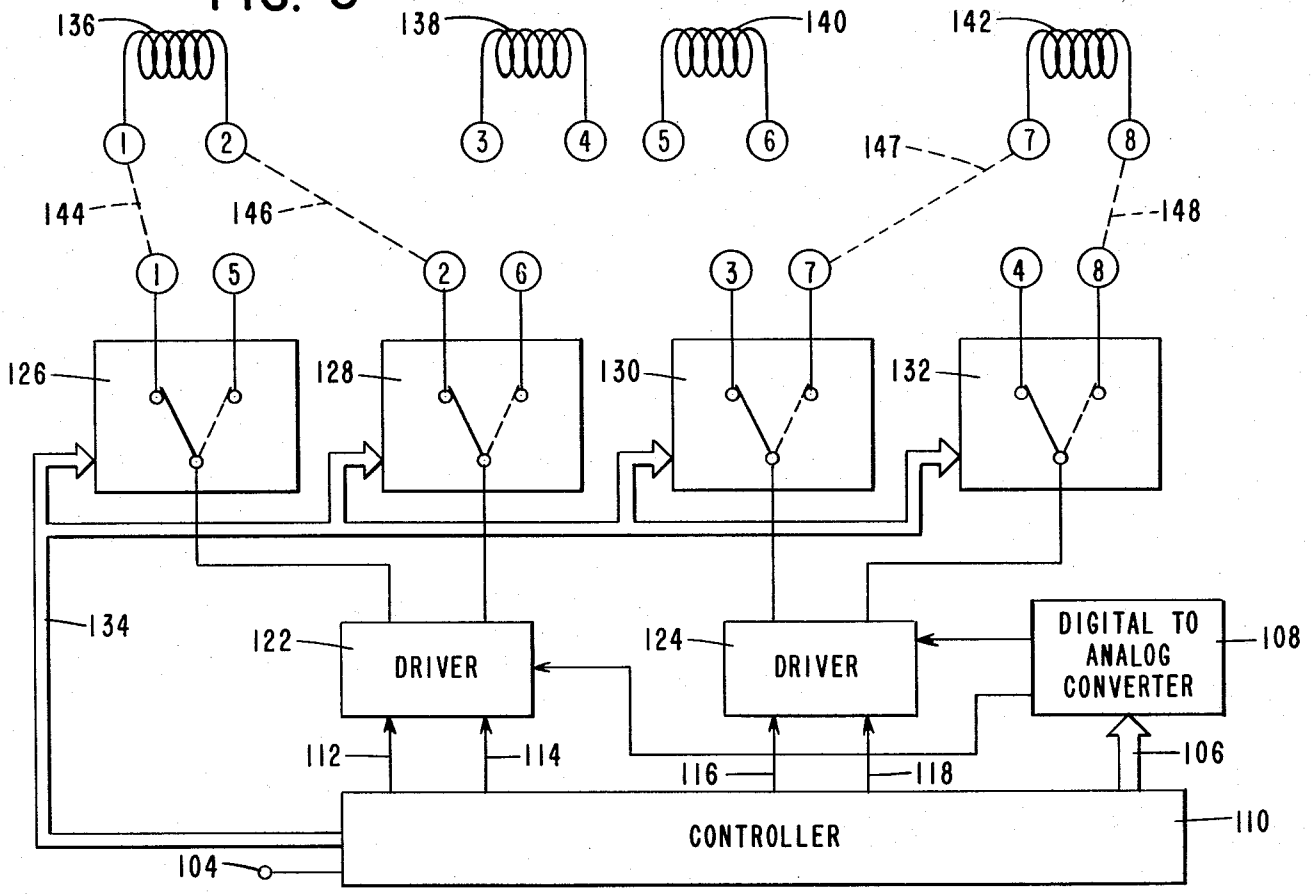
FIG. 5 is a schematic diagram showing means for energizing a plurality of coils using the driver circuit of FIG. 4.

In the embodiment of FIGS. 4 and 5, a digital to analog converter 108, which may be of type AD7523, made by Intersil Inc., of Sunnyvale, Calif., is connected by an 8-bit conductor 106 to a controller 110 comprising a suitably programmed microprocessor, which may be of type 8048 manufactured by Intel Corporation of Santa Clara, Calif. Information relevant to the printing operation may be provided to the controller 110 by suitable means, represented diagrammatically in FIG. 5 by the input 104. This information may be utilized by the controller 110 to provide the necessary output signals to the remainder of the circuit in a manner similar to that previously described for the controller 100. The controller 110 also provides two sets of logic inputs 112, 114 and 116, 118 to a pair of drivers 122 and 124. The driver 122 is shown in greater detail in FIG. 4, and it should be understood that driver 124 is essentially identical to it.

Connected to the drivers 122 and 124 are a plurality of analog switches 126, 128, 130 and 132, each of which may be a dual SPDT switch, of type HI5051, manufactured by Harris Semiconductor Analog Products Division, Melbourne, Fla. Operation of each of these switches is controlled by a bus 134, extending from the controller 110 to each switch. The analog switches 126, 128, 130, 132 are in turn connected to a plurality of coils 136, 138, 140 and 142 in a manner represented in FIG. 5 by correspondingly numbered terminals and dashed lines such as lines 144, 146, 147 and 148.

Referring now to FIG. 4, threshold voltages such as $V_{TH1}$ and $V_{TH2}$ are generated by the digital to analog converter 108 under control of the controller 110, and are applied to the positive terminals of comparators 150 and 152, which may be of type LM339, manufactured by National Semiconductor Corporation, Santa Clara, Calif.

It will be seen that the circuit configuration of the driver 122 includes two branches, each of which is coupled to a terminal of one of the analog switches 126 and 128. The left branch includes two NPN transistors 154 and 156, which may be of type 2N6388, and also includes two diodes 158 and 160, which may be of type 1N4001, and which are included in the circuit to protect the transistors 154 and 156 from back EMF produced when a coil such as the coil 136 is deenergized.

The collector of the transistor 154 is connected at 162 to a source of potential, shown as +28 volts DC, though some other suitable potential value such as +12 volts could be employed, with appropriate adjustment of other circuit parameters. The collector is also connected through the diode 158 to a node 164, from which one circuit path extends to one terminal of the switch 126. A second circuit path extends from the node 164 to the emitter of the transistor 154; a third circuit path extends from the node 164 to the collector of the transistor 156; and a fourth circuit path extends from the node 164 through the diode 160 to the emitter of the transistor 156 and through a current sensing 0.75-ohm, 2-watt resistor 166, to a base reference potential, shown as ground.

The first logic input 112 is connected through an open collector gate 168, which may be of type 7407, to the base of the transistor 156 and to the base of a transistor 170 in the right circuit branch. The second logic input 114 is connected through an open collector gate 172, which may be of type 7407, to the base of the transistor 154 and to the base of a transistor 174 in the right circuit branch.

It will be recalled that the threshold voltage $V_{TH1}$ from the converter 108 is applied to the positive input terminal of the comparator 150. The output of this comparator is connected to the base of the transistor 156, to which is also connected a potential of +5 volts through a 10,000-ohm pull-up resistor 176. A feedback path extends from the output of the comparator 150 through a 390,000-ohm resistor 178 to the positive input terminal thereof. The negative input terminal is connected through a 2,400-ohm resistor 180 to one end of the current sensing resistor 166.

One terminal of the analog switch 128 is coupled via a conductor 182 to the right branch of the circuit of FIG. 4, which includes the NPN transistors 170 and 174, diodes 184 and 186, a sense resistor 188 and the comparator 152. The various circuit paths connecting these components are similar to the corresponding circuit paths of the left branch, as may be seen from an inspection of FIG. 4.

As is the case with the circuit of FIG. 3, the logic levels on inputs 112, 114 determine the direction of current flow within whatever coil is operatively connected via the analog switches 126, 128, 130 and 132 to the drivers 122 and 124.

In FIG. 4, the magnitude of current flow through the selected coil is determined by the voltage $V_{TH1}$ applied to the positive input terminals of the comparators 150 and 152 from the digital to analog converter 108. The comparator 150, for example, compares the voltage $V_{TH1}$ with the voltage applied to the negative terminal of said comparator, which is essentially the product of the coil current flowing through the resistor 166 and the resistance of said resistor. So long as this voltage is lower in magnitude than the threshold voltage $V_{TH1}$ applied to the positive terminal of the comparator 150, the output of said comparator, which is applied to the base of the transistor 156, remains positive, and the transistor continues to conduct.

However, when the voltage applied to the negative terminal of the comparator 150, as determined by the product of the coil current and the resistance of the sensing resistor 166, exceeds the threshold voltage $V_{TH1}$, the output of the comparator 150 goes negative, and causes the transistor 156 to turn off, thus interrupting the coil energizing circuit, and causing the current through the sensing resistor 166 to drop.

It will be seen that this action produces an average coil energizing current value, of generally sawtooth waveform, which corresponds to the threshold voltage $V_{TH1}$ produced by the controller 110, acting through the digital to analog converter 108, for as long as the logic input 112 remains true.

It will also be seen that the controller 110, acting on the analog switches 126, 128, 130 and 132 through the bus 134, can selectively control the energization of coils 136, 138, 140 and 142, using only two drivers 122 and 124, thus reducing the number of components employed, to provide a more economical circuit configuration. Of course, the particular number of coils, switches and drivers shown is only exemplary, and other combinations could readily be used to provide configurations required in particular applications.

Figure 6:
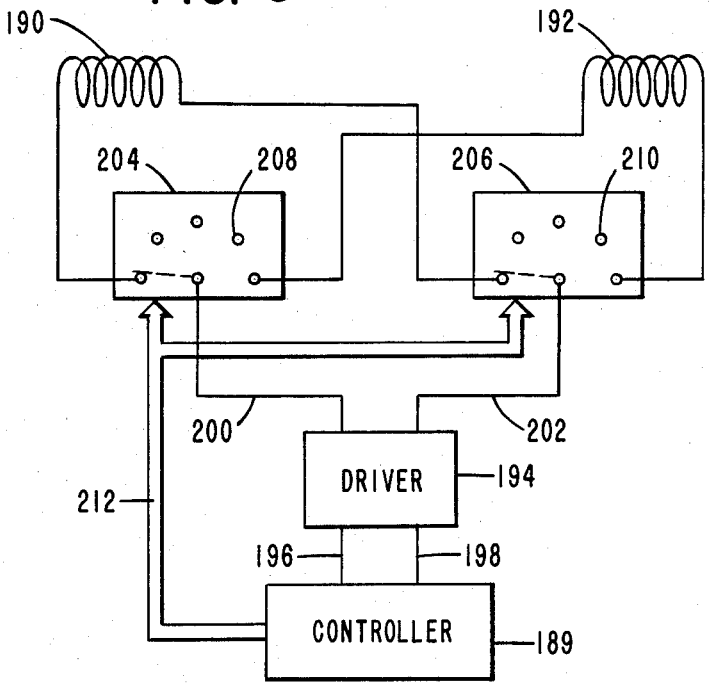
FIG. 6 is a schematic diagram of a further embodiment of the invention.

A further embodiment of the invention is shown in FIG. 6. In this embodiment, only one coil, such as coil 190 or 192 of a predetermined number of coils, five in this example, is energized at any one time. This permits the use of only a single driver 194, thus reducing the number of components employed. Logic inputs 196 and 198 from a controller 189 are applied to the driver 194, which may be essentially identical to the driver of FIG. 3. The outputs 200 and 202 of the driver are applied to terminals of two multiple-position switches 204 and 206 of suitable design, each of which is provided with a number of terminals 208 and 210 equal to the number of coils such as 190 and 192. A control bus 212 extending from the controller 189 to the switches 201 and 206 controls the simultaneous movement of said switches from one position to another, to provide the desired sequence of coil energization.

While the forms of the invention illustrated and described herein are particularly adapted to fulfill the objects aforesaid, it is to be understood that other and further modifications within the scope of the following claims may be made without departing from the spirit of the invention.

What is claimed is:

1. Variable impact printing mechanism comprising in combination:

hammer means capable of moving in a generally linear path between a rest position and an operated position in which said hammer means cooperates with said print indicia element to effect printing upon a record medium;

support means capable of defining the path of the hammer means;

a plurality of electromagnetic coil means mounted in operative relation to said support means, each of said coil means being capable of incrementally affecting the movement of said hammer means along said path;

driving means for energizing each of said electromagnetic coil means; and controller means comprising a microprocessor and look-up table means for controlling said driving means by predetermined control signal combinations in response to input data representing different print requirements to cause said plurality of electromagnetic coil means to act in combination to move said hammer means along said path at desired velocities, to provide varying printing impact forces in response to varying printing requirements.

2. The printing mechanism of claim 1, in which said driving means are capable of energizing their associated electromagnetic coil means in either of two directions selectively to provide a driving force or a braking force on said hammer means.

3. The printing mechanism of claim 2, in which each of said driving means includes two alternate circuit paths for energization of said electromagnetic coil means in either one of two selected directions.

4. The printing mechanism of claim 3, in which each of said circuit paths comprises a pair of transistors connected in series with said electromagnetic coil means and in which a first logic input from said controller means is coupled to one transistor in each circuit path and a second logic input from said controller means is coupled to the second of each pair of transistors in each of said circuit paths.

5. The printing mechanism of claim 1, in which said controller means is capable of controlling said driving means to energize selected electromagnetic coil means at selected times so as to exert a braking force on said hammer means when said hammer means has progressed along its path to a position past said selected electromagnetic coil means.

6. The printing mechanism of claim 1, in which said controller means is capable of causing the energization of said electromagnetic coil means sequentially in order as they are positioned with respect to said support means, and in the same direction of energization, in order to impart the maximum energy to said hammer means.

7. The printing mechanism of claim 1, in which said controller means is capable of causing the energization of at least one of said electromagnetic coil means in a direction opposite to the energization of the other coil means in order to apply a braking force to said hammer means and thus decrease the energy with which it interacts with said print indicia element.

8. The printing mechanism of claim 1, wherein said driving means comprises a single driving circuit, and also including multi-position switching means coupling the driving means to the coil means, whereby said single driving circuit is capable of sequentially energizing more than one coil means.

9. The printing mechanism of claim 1, also including current control means for varying the magnitude of the energizing current applied to selected ones of said electromagnetic coil means, comprising digital to analog converter means for providing a threshold voltage under control of said controller means, sensing means for providing a sensing voltage dependent upon the coil means energizing current, comparator means for comparing the threshold voltage and the sensing voltage and for controlling the energizing current in response to such comparison.

10. The printing mechanism of claim 9, also including selector switching means coupling the driving means to the electromagnetic coil means, whereby each driving means is capable of energizing more than one coil means.

11. A method for producing variable impact of a print hammer in a printing mechanism during a printing operation comprising the following steps:

providing a plurality of aligned electromagnetic driving means each capable of incrementally affecting the movement of a printing hammer along a predetermined path; and sequentially energizing said electromagnetic driving means to cause said driving means to act in combination to move said hammer means along said path at desired velocities, to provide varying printing impact forces in response to varying printing requirements, at least one of said electromagnetic driving means being energized out of time sequence with respect to its relative physical position with respect to the remaining driving means in order to provide a braking effect upon said hammer velocity.

* * * * *

Disclaimer 4,493,253.—*Arvindkumar C. Vyas,* Waterloo, Canada. VARIABLE IMPACT PRINTING MEANS. Patent dated Jan. 15, 1985. Disclaimer filed July 2, 1985, by the assignee, *NCR Canada LTD-NCR Canada LTEE.*

Hereby enters this disclaimer to claim 1 of said patent.

[*Official Gazette August 27, 1985.*]